United States Patent [19]

Gröger et al.

[11] Patent Number: 4,903,644

[45] Date of Patent: Feb. 27, 1990

[54] AIR INTAKE SECTION OF AN INTERNAL COMBUSTION ENGINE

[75] Inventors: Klaus Gröger, Hemmingen; Herbert Ampferer, Sachsenheim, both of Fed. Rep. of Germany

[73] Assignee: Dr. Ing.h.c.F. Porsche AG, Weissach, Fed. Rep. of Germany

[21] Appl. No.: 382,897

[22] Filed: Jul. 21, 1989

[30] Foreign Application Priority Data

Jul. 21, 1988 [DE] Fed. Rep. of Germany ..... 3824792

[51] Int. Cl.[4] ..... F02M 35/10

[52] U.S. Cl. ..... 123/52 MC

[58] Field of Search ..... 123/52 MC, 52 M, 52 MB, 123/52 MV, 572

[56] References Cited

U.S. PATENT DOCUMENTS

| | | | |
|---|---|---|---|
| 4,372,120 | 2/1983 | Ford, Jr. et al. | 123/52 M |
| 4,565,166 | 1/1986 | Takeda | 123/52 MB |
| 4,628,873 | 12/1986 | Bitter | 123/52 M |
| 4,643,136 | 2/1987 | Ura et al. | 123/52 M |

*Primary Examiner*—David A. Okonsky

*Attorney, Agent, or Firm*—Barnes & Thornburg

[57] ABSTRACT

An elastic pipe piece, which is arranged between the air filter and a throttle housing in the air intake section, in proximity of both ends, has one bellows respectively pointing to the outside. The bellows compensate tolerances and have a vibration-disconnecting effect. Two pipe sockets are contructed integrally with the pipe piece, a crankcase ventilating system or an idling adjuster being connected to these pipe sockets. In addition, in proximity of an accommodating means, a clamping fork is constructed integrally with the pipe piece, which accommodates the idling adjuster and fixes it in position.

8 Claims, 1 Drawing Sheet

AIR INTAKE SECTION OF AN INTERNAL COMBUSTION ENGINE

BACKGROUND AND SUMMARY OF THE INVENTION

The invention relates to an air intake section.

It has been disclosed to remove crankcase gases of an internal-combustion engine into its air intake section. In U.S. Pat. No. 33,64,910 a crankcase ventilating pipe is branched before entering the air intake section in such a manner that the main ventilating point leads into a pipe piece between the air filter and the throttle housing, and the secondary ventilating point leads behind the throttle valve into the air intake section. In addition, it has been disclosed to produce the pipe piece between the air filter and the throttle housing of a rubber-elastic material.

A disadvantage in this type of a construction is the contracting of this pipe piece as a result of the vacuum in the air intake section which exists in certain throttle valve positions. Although the mounting of stiffening ribs on the pipe piece reduces the contraction, it considerably increases the manufacturing costs for this part. Also, these pipe pieces can compensate only to a limited extent during the assembly any tolerances between the air filter which is disposed to be fixed at the body and the throttle housing disposed on the engine side.

Accordingly, it is an object of the present invention to construct an elastic, but nevertheless pressure-resistant, pipe piece with a vibration-disconnecting effect in such a manner that the pipe piece serves for accommodating supplemental assemblies and also compensates tolerances occurring between the air filter and the throttle housing of an internal-combustion engine.

Main advantages achieved by preferred embodiments of the present invention include a more effective compensation of tolerances between the air filter and the throttle housing as well as a good disconnection of vibrations between the two parts due to the provision of ring-shaped elastic bellows adjacent ends of the pipe piece. The narrow wall thickness of the bellows allows an easy shifting of the ends of the pipe piece relative to the pipe piece while maintaining a sufficient stiffness of the bellows against any contraction. In addition, connecting parts, such as an idling adjuster, can be inserted in a simple manner into two receiving devices which are shaped onto the pipe piece and are constructed as pipe sockets. The stiffness of the material used for the pipe piece may be selected to be so high that any contraction as a result of a vacuum is impossible.

Advantageously, the idling adjuster inserted into one pipe socket is fixed by a clamping fork molded onto the pipe piece on the outside. Thus, the expenditures for a separate fastening of the idling adjuster are not required. The elastic material permits the expanding of the clamping fork as well as of the pipe sockets and of the ends of the pipe piece in order to connect pipes or other parts. The elastic restoring forces of the material embrace and fix these parts. The pipe piece can be produced at low cost as a molded part from plastic material or rubber and can be connected in a simple manner to the parts which are adjacent to the pipe piece.

Other objects, advantages and novel features of the present invention will become apparent from the following detailed description of the invention when considered in conjunction with the accompanying drawings.

DETAILED DESCRIPTION OF THE DRAWINGS

Figures 1, 2:
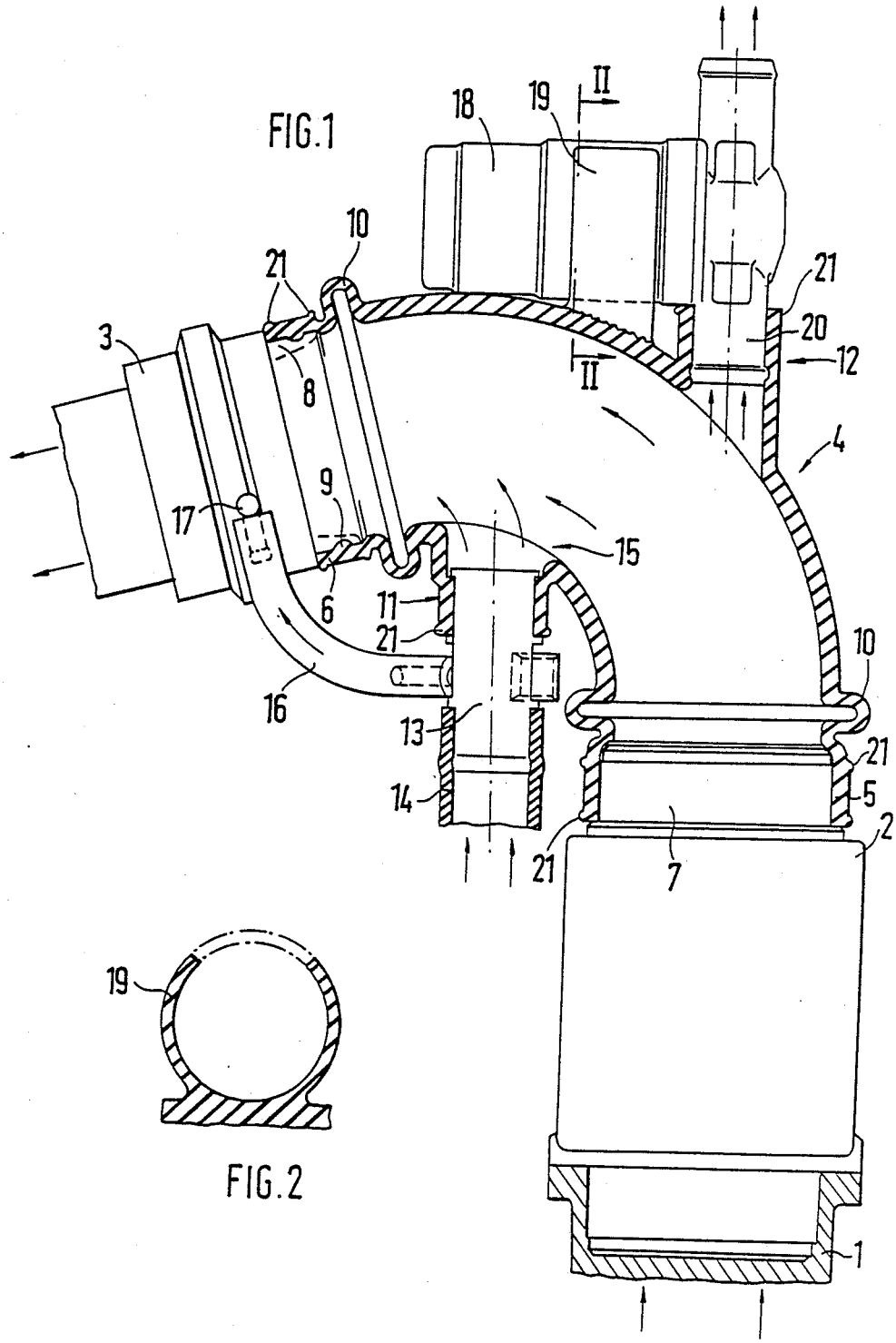
FIG. 1 is a view of an air intake section having an elastic pipe piece which is bent by almost 90°.
FIG. 2 is a sectional view taken along Line II—II of FIG. 1.

An embodiment of an air intake section having an elastic pipe piece, which has integrated pipe sockets for pipes or parts to be connected, is shown in the drawings and will be described in detail in the following.

The air intake section of an internal-combustion engine, (not shown) includes an air filter 1, an air-flow sensor 2, a throttle housing 3 and a pipe piece 4 which is arranged in-between and is constructed as almost a quarter bend. The cylindrical ends 5, 6 of the pipe piece 4 are fitted onto such connecting sockets 7, 8 of the air flow sensor 2 or of the throttle housing 3. On the inside, the cylindrical end 6 has a radial projection which engages in a recess on the connection tube 8 which corresponds to it. In proximity of both ends 5, 6, the pipe piece 4 has one bellows 10 respectively pointing toward the outside. The wall thickness of the bellows 10 is less than that of the remaining pipe piece 4.

Thus, the stiffness of the pipe piece 4 is reduced in the area of the bellows 10, and the ends 5, 6 can easily be shifted with respect to the pipe piece 4 in an axially and radially elastic manner. In this fashion, the pipe piece 4 compensates tolerances in the position of the connection sockets 7, 8 with respect to one another. Likewise, vibrations transmitted from the internal-combustion engine to the throttle housing 3 can effectively be kept away from the air flow sensor 2 and the air filter 1.

Between the bellows, two cylindrical pipe sockets 11, 12, which point toward the outside, are arranged integrally with the pipe piece 4. A heating element 13 is fitted into the pipe sockets 11 to which a crankcase ventilation pipe 14 is connected. In the load operation of the internal-combustion engine, the crankcase gases are removed into the pipe socket 11 by way of a main ventilating point 15. In the coasting or idling operation of the engine, i.e. when the throttle valve is closed, the crankcase gases, by means of a pipe 16 connected to the heating element 13, behind the throttle valve, are introduced into a secondary ventilating point 17.

A cylindrical connection 20 of the idling adjuster 18 is inserted directly, thus without any additional connecting pipe, into the pipe socket 12. In direct proximity of the pipe socket 12, a clamping fork 19 is constructed integrally with the pipe piece 4, the shape of this clamping fork 19 being shown in FIG. 2. As indicated in FIG. 2, the clamping fork 19 may also have a circular construction. The idling adjuster 18, by the clamping fork 19 and the pipe socket 12, is clearly fixed in its position and thus does not require any separate fastening material and no connecting line leading from the pipe piece 4 to it.

On the outside, the cylindrical ends 5, 6 and the pipe sockets 11, 12 each have at least one surrounding projection 21. These projections 21, in an axial direction, fix tightening straps, which are not shown and which ensure an airtight fit at the corresponding points.

The material and the wall thicknesses of the pipe piece 4 are selected to be such that a contraction is prevented which is caused by a vacuum, but that there is still an elasticity (shore hardness approximately 55–60) which is sufficient for a compensating of tolerances and the disconnecting of vibrations. The smooth outer surface of the pipe piece 4 permits the use of an injection mold which clearly can be manufactured at less cost than in the case of a construction with a narrower wall thickness but with stiffening ribs mounted on the outside.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. An air intake section of an internal combustion engine comprising:

an elastic pipe piece means arranged between an air filter and a throttle housing;

ring-shaped elastic bellows means, which are curved towards an outside of the pipe piece means, positioned adjacent ends of the pipe piece means, the bellow means having a wall thickness less than a wall thickness of the pipe piece means;

pipe socket means for connecting air-carrying pipes to the pipe piece means and clamping fork means for connecting a component to the pipe piece means.

2. An air intake section according to claim 1, wherein the clamping fork means completely encloses a component fixed in it.

3. An air intake section according to claim 1, wherein the clamping fork means more than half encloses a component fixed in it.

4. An air intake section according to claim 1, wherein an idling adjuster means is fixed in the clamping fork means, the idling adjuster means having a cylindrical connection for insertion into the pipe socket means.

5. An air intake section according to claim 1, wherein the wall thickness of the pipe piece means amounts to at least about 4 mm, and wherein the pipe piece means is made of a rubber material with a shore hardness of approximately 55–60.

6. An air intake section according to claim 1, wherein the pipe piece means is constructed as almost a quarter of an elbow.

7. An air intake section according to claim 1, wherein the pipe socket means includes first and second pipe socket means in a bending plane of the pipe piece means, which lead into the pipe piece means at opposite points, and wherein central axes of the first and second pipe socket means are aligned almost in parallel with respect to an air flow direction at an inlet side end of the pipe piece means.

8. An air intake section according to claim 1, wherein the ends of the pipe piece means and the first and second pipe socket means, on an outside, have at least one surrounding projection means which is used for the fixing of tightening strap means.

* * * * *